US005367322A

United States Patent [19]

Sogami et al.

[11] Patent Number: 5,367,322

[45] Date of Patent: Nov. 22, 1994

[54] THERMAL RECORDING APPARATUS

[75] Inventors: Atsushi Sogami, Sanda; Noboru Katakabe, Uji; Yoshikawa Masanori, Neyagawa; Kouji Ikeda, Katano, all of Japan

[73] Assignee: Matsushita Electric Industrial Co., Ltd., Osaka, Japan

[21] Appl. No.: 957,102

[22] Filed: Oct. 7, 1992

[51] Int. Cl.[5] ..... B41J 2/325

[52] U.S. Cl. ..... 346/76 PH

[58] Field of Search ..... 346/76 PH; 400/120

[56] References Cited

U.S. PATENT DOCUMENTS 4,882,593 11/1989 Touma et al. ..... 346/76 PH
5,168,289 12/1992 Katakabe et al. ..... 346/76 PH

FOREIGN PATENT DOCUMENTS 0227254 10/1991 Japan .
0240565 10/1991 Japan .
0201266 7/1992 Japan .

*Primary Examiner*—Benjamin R. Fuller
*Assistant Examiner*—Huan Tran
*Attorney, Agent, or Firm*—Wenderoth, Lind & Ponack

[57] ABSTRACT

A thermal recording apparatus comprises a thermal recording head supported for movement right towards and away from an intermediate transfer drum. The intermediate transfer drum has a peripheral surface formed with an ink transfer layer of silicone rubber and is supported to be rotated in one direction successively past a recording station at which the thermal recording head is positioned and a transfer station at which an inked image transported by the intermediate transfer drum is transferred onto a recording paper. A heating lamp is installed coaxially inside the intermediate transfer drum for heating the ink transfer layer to a predetermined unique temperature so that the inked image formed on the intermediate transfer drum at the recording station can be transferred onto the recording paper at the transfer station to complete a recording of an image on the recording paper.

12 Claims, 6 Drawing Sheets

THERMAL RECORDING APPARATUS

BACKGROUND OF THE INVENTION

1. Field of the Invention

The present invention relates to a thermal recording apparatus utilizable in a printer, a digital copier and a facsimile machine for recording imagewise information such as, for example, one or a combination of images and alpha-numeric characters on a recording sheet.

2. Description of the Prior Art

As a thermal recording system in a printer, a thermal transfer recording system is now popularized in which a thermal head is employed in combination with an ink sheet. This thermal transfer recording system is disclosed in, for example, the Japanese Patent Publications No. 62-47717 and No. 63-50198. According to the well-known thermal transfer recording system, the thermal head including a row of heating elements is driven to contact the recording sheet with the ink sheet intervening therebetween. The instant the thermal head is so driven, some of the heating elements in the thermal recording head are selectively energized in response to an electric image signal to melt an ink layer on the ink sheet for deposit on the recording sheet in conformity with the image information carried by the electric image signal.

The thermal transfer recording system has however a problem in that inking material thermally detached from the ink sheet does not satisfactorily deposit on a recording sheet having surface irregularities. Specifically, when it comes to the thermal transfer color recording system such as disclosed in the Japanese Patent Publication No. 63-50198 wherein inking media of three primary colors are deposited in an overlapped relation to give a desired color in the image printed on the recording sheet, the quality of the color image finally printed on the recording sheet tends to be reduced since the deposition of one of the inking media on the recording sheet results in a surface roughening of the recording sheet and, therefore, hampers a satisfactory deposition of the next succeeding one of the inking media on the same recording sheet. This known color recording system has an additional problem in that the recording sheet once deposited with the inking medium of one color at a recording station is apt to be displaced from the recording station when it is repositioned for a deposition of the inking medium of the different color, resulting in an insufficient color reproduction.

The Japanese Patent Publication No. 59-16932 and the Japanese Laid-open Patent Publication No. 62-248669 disclose the recording of image information on not only recording sheets of good surface quality, but also those of low surface quality. According to these publications, the ink image is formed on an intermediate transfer medium and is subsequently transferred from the intermediate medium onto a recording sheet. However, since the inking material deposited on the intermediate transfer medium does not completely detach from the intermediate transfer medium at the time of transfer thereof onto the recording sheet, ink remains on the intermediate transfer medium, and the use of a specially designed cleaning unit is therefore required for removing the ink remains from the intermediate transfer medium.

Also, according to any one of the Japanese Patent Publication No. 59-16932 and the Japanese Laid-open Patent Publication No. 62-248669, the intermediate transfer medium is required to be heated selectively to a temperature when brought to a recording station and also to a different temperature when brought to a transfer station.

To accomplish the selective heating of the intermediate transfer medium to one of the different temperatures, the use is necessitated of a cooling unit in combination with a heating unit, making the recording apparatus as a whole bulky and expensive and also reducing the efficiency of energy use.

SUMMARY OF THE INVENTION

Accordingly, the present invention has been developed with a view to substantially eliminating the above discussed problems and is intended to provide an improved thermal recording apparatus of a kind effective to accomplish a satisfactory image recording regardless of the quality of recording sheets and, hence, to provide recordings at a reduced running cost.

Another important object of the present invention is to provide an improved thermal recording apparatus of the type referred to above, which does not require the use of any cooling unit.

A further object of the present invention is to provide an improved thermal recording apparatus of the type referred to above, which is effective to accomplish an accurate and precise repositioning of a recording sheet at a predetermined position to achieve an accurate superimposition of ink media of different colors on the same recording sheet during a color ink recording.

According to the present invention, a thermal recording apparatus comprises a thermal recording head supported for movement close towards and away from an intermediate transfer member. The intermediate transfer member is made of silicone rubber having a relatively high ink release property and also having an elasticity. This intermediate transfer member is supported for movement so as to successively pass a recording station, at which the thermal recording head is positioned, and a transfer station at which an inked image transported by the intermediate transfer member is transferred onto a recording paper. A heating means is employed for heating the intermediate transfer member to a predetermined unique temperature so that the inked image formed on the intermediate transfer member at the recording station can be transferred onto the recording paper at the transfer station to complete a recording of an image on the recording paper.

At the transfer station, the recording paper onto which the inked image is to be transferred is pressed against the intermediate transfer member by means of a press roll supported by a pivot lever for movement close towards and away from the intermediate transfer member.

The predetermined temperature to which the intermediate transfer member is heated is so chosen that the cohesive strength of ink material forming the ink layer is higher than the adhesive strength between the ink material and the intermediate transfer member and, at the same time, the ink material forming the inked image on the intermediate transfer member can be softened or fused for deposit on the recording paper.

According to the present invention, the intermediate transfer member is heated to the predetermined temperature at all times during the operation of the thermal recording apparatus and need not be alternately heated and cooled to maintain it at the predetermined temperature. Therefore, the thermal recording apparatus as a whole can be constructed to have a simple structure and be compact in size.

The use of the silicone rubber as material for the intermediate transfer member is advantageous in that a tight contact between the ink sheet and it and also between it and the recording paper is readily available to ensure a sufficient and complete transfer of the ink material onto the intermediate transfer member and that of the inked image from the intermediate transfer member onto the recording paper.

The thermal recording apparatus of the present invention can be used for a color image recording with the use of an ink sheet of a type having a row of cyclic color ink segments of different colors.

The intermediate transfer member may be either a rotatably supported drum or an endless belt.

BRIEF DESCRIPTION OF THE DRAWINGS

These and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Figure 1:
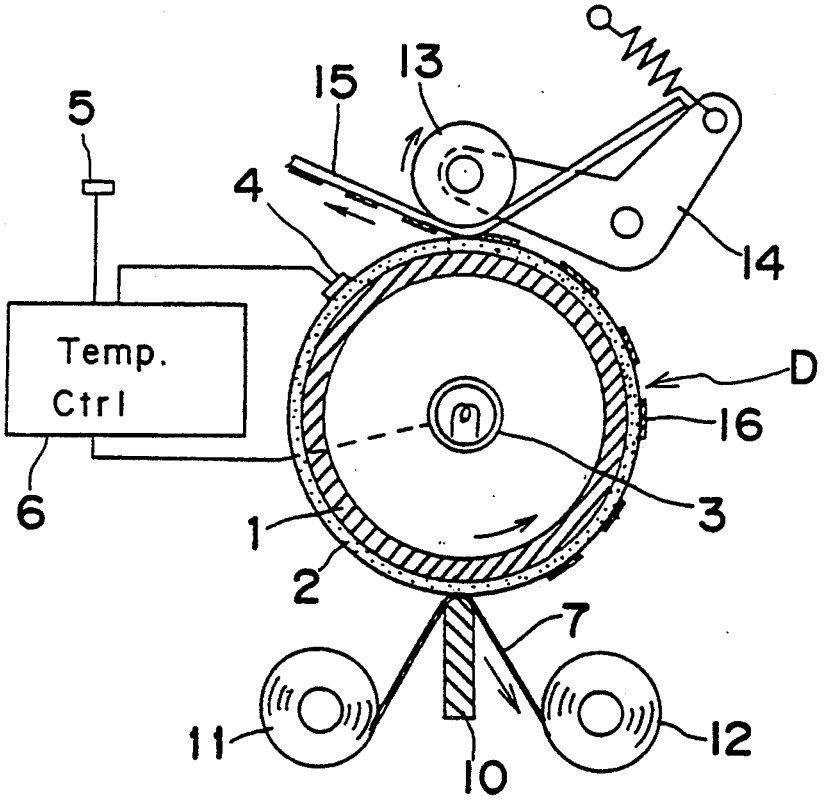
FIG. 1 is a schematic side sectional view of a thermal recording apparatus according to a first preferred embodiment of the present invention.
Figure 2:
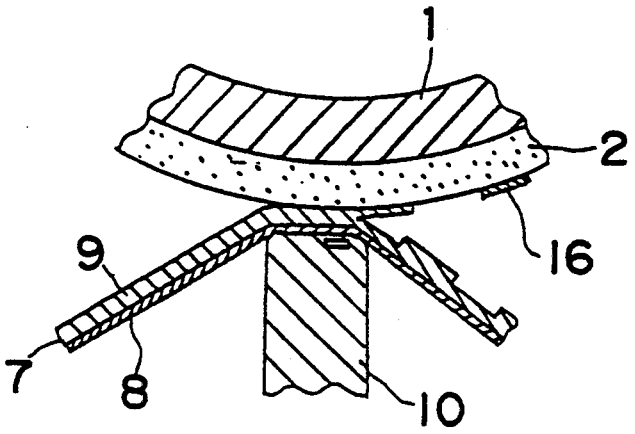
FIG. 2 is a side sectional view, on an enlarged scale, of a portion of the recording apparatus of FIG. 1, showing how an ink media is transferred onto an intermediate transfer drum.
Figure 3:
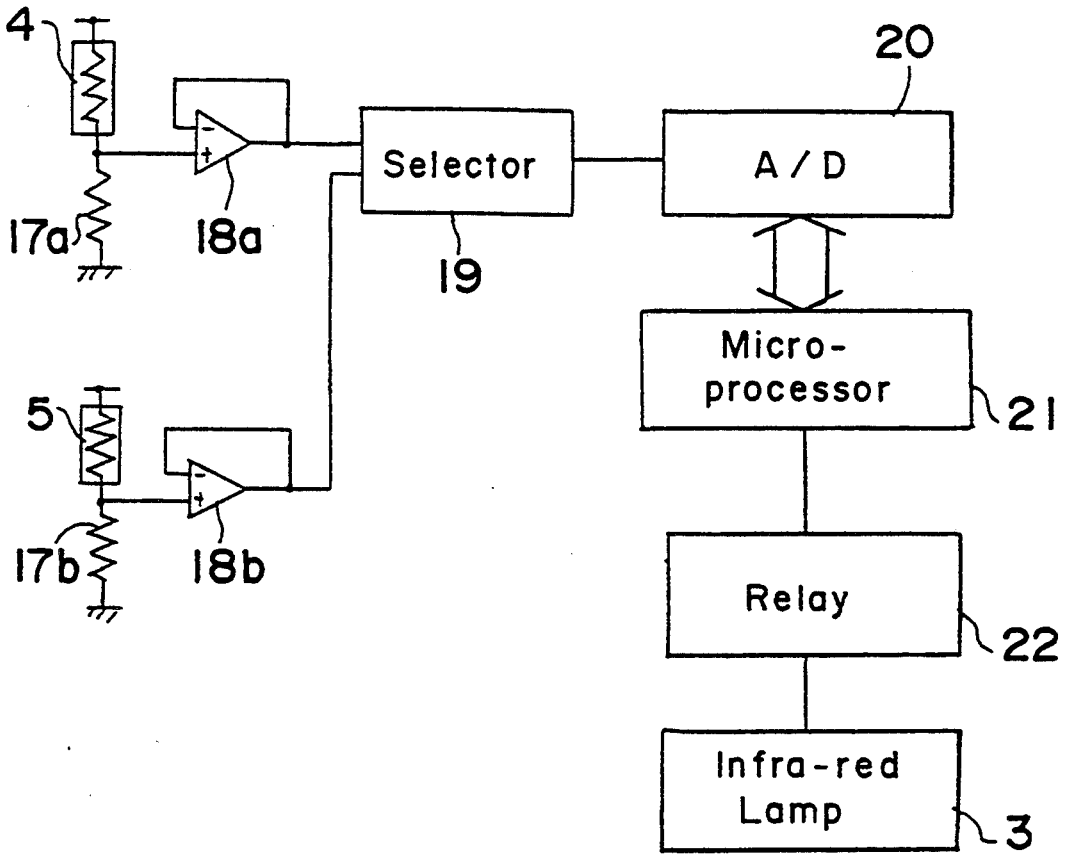
FIG. 3 is a circuit block diagram showing a temperature control circuit employed in the thermal recording apparatus.

Referring first to FIGS. 1 to 3, a thermal recording apparatus shown therein comprises an intermediate transfer drum adapted to be driven in one direction shown by the arrow by means of a suitable drive means (not shown) and comprising a metallic cylinder 1 having an intermediate transfer medium 2 lined over the entire circumference thereof so as to form a layer having a thickness not smaller than 0.2 mm. The intermediate transfer drum generally identified by D has a predetermined length parallel to the axis of rotation thereof which is sufficient to accommodate the maximum available width of the recording papers with which the apparatus of the present invention works.

The intermediate transfer medium 2 has a high ink release characteristic and is preferably made of silicone rubber having a hardness within the range of 30 to 70 degrees. This silicone rubber may be of a kind disclosed in, for example, U.S. Pat. No. 3,554,836. In any event, so far illustrated, the intermediate transfer medium 2 has a thickness chosen to be 1 mm and is made of silicone rubber having a hardness of 50 degrees.

The intermediate transfer drum D has a hollow defined therein and includes a generally elongated infrared lamp 3 disposed coaxial therewith so as to extend a distance corresponding to the length of the intermediate transfer drum D. As will become clear from the subsequent description, the infrared lamp 3 is employed to heat the intermediate transfer drum D and, more specifically, to heat the intermediate transfer medium 2 through the metallic cylinder 1 to a predetermined temperature.

The thermal recording apparatus also comprises heating means for heating the intermediate transfer drum D, particularly the intermediate transfer medium 2, to a predetermined surface temperature. This heating means comprises, in addition to the infrared lamp 3 referred to above, a surface temperature sensor 4 which may be a thermistor and which is supported in sliding contact with a marginal portion of the intermediate transfer medium 2 for detecting the surface temperature of the intermediate transfer medium 2, and an ambient temperature sensor 5 which may also be a thermistor and which is installed inside a machine casing for detecting the ambient temperature in the environment in which the intermediate transfer drum D is installed.

The surface and ambient temperature sensors 4 and 5 and the infrared lamp 3 are electrically connected with a temperature control circuit 6 designed to change a preset temperature of heating of the intermediate transfer medium 2 according to the ambient temperature detected by the ambient temperature sensor 5 arid also to control the infrared lamp 3 according to the surface temperature detected by the surface temperature sensor 4 to maintain the surface temperature of the intermediate transfer medium 2 at the preset temperature.

An of ink sheet (or ink ribbon) 7 having a width corresponding to the maximum available width of the recording papers is supplied by means of a suitable drive means (not shown) from a supply reel 11 onto a take-up reel 12 past a recording station at which a thermal recording head 10 is positioned. This ink ribbon 7 comprises an elongated backing 8 in the form of a plastic film with a thickness, and of 3 to 9 $\mu$m layer 9 of thermally fusible ink material deposited uniformly on one surface of the elongated backing 8. The thermally fusible ink material may be of any known kind which is prepared by using as a binder, thermoplastic resin such as, for example, natural or synthetic wax, polyamide resin or polyacrylic resin, into which carbon black and/or any suitable coloring agent is dispersed. Preferably, the thermally fusible ink material has a melting point within the range of 50° to 160° C. Alternatively, in a case in which the thermally fusible ink material has a binder with an unknown melting point, the thermally fusible ink material may have a softening point within the range of 40° to 180° C. according to the ring and ball method.

However, in the practice of the present invention, the thermally fusible ink material prepared by the use of a mixture of wax and thermoplastic resin as a binder has a melting point of 68° C. (Peak melting point according to DSC) and has a viscosity of 60 poises at 100° C. This particular thermally fusible ink material is applied onto the surface of the backing 8 so as to form the ink layer 9 having a thickness of 8 μm.

The thermal recording head 10 has a row of heating elements extending in a direction generally parallel to the axis of rotation of the intermediate transfer drum D and is supported in any known manner between a rest position, in which the thermal recording head 10 is separated away from the intermediate transfer drum D, and an operative position in which, as shown in FIGS. 1 and 2, the thermal recording head 10 is brought into contact with the intermediate transfer drum D with the ink ribbon 7 intervening therebetween.

The recording apparatus furthermore comprises a press roll 13 for urging a recording paper 15 against the intermediate transfer drum D at a location spaced from the recording station in a circumferential direction of the intermediate transfer drum D. This press roll 13 is rotatably carried by a spring-biased pivot lever 14 that is urged in one direction, for example, counterclockwise as viewed in FIG. 1, by a spring element with the press roll 13 consequently biased so as to contact the intermediate transfer drum D as shown in FIG. 1, the pivot lever 4 can be pivoted clockwise by a suitable drive mechanism (not shown) to separate the press roll 13 away from the intermediate transfer drum D when no recording paper is fed across a transfer station at which ink deposits are successively transferred from the intermediate transfer drum D onto the recording paper 15.

Referring particularly to FIG. 3, each of the temperature sensors 4 and 5 are connected in series with a respective resistor 17*a* or 17*b* so that the resistance of the thermistor forming the corresponding temperature sensor 4 or 5 can vary with a change in temperature. As is well known to those skilled in the art, the voltage appearing at the junction between the resistor 17*a* or 17*b* and the associated sensor 4 or 5 varies with a change in resistance of the associated sensor 4 or 5.

The temperature sensors 4 and 5 are connected through respective buffers 18*a* and 18*b* with a selector 19 which is in turn connected with an analog-to-digital converter (A/D) 20. The selector 19 is operable to select one of the voltages outputted respectively from the temperature sensors 4 and 5 and then to supply the selected voltage to the analog-to-digital converter 20. The analog-to-digital converter 20 is connected with a microprocessor 21 through a data bus.

On the other hand, the infrared lamp 3 is electrically connected in series with a solid-state relay 22 operable to selectively switch the infrared lamp 3 on or off according to a state (ON or OFF) of the relay 22. This solid-state relay 22 is controlled by an output fed from the microprocessor 21.

The thermal recording apparatus of the construction described above operates in the following manner.

Assuming that the recording apparatus is electrically powered on, the microprocessor 21 issues a command by which the selector 19 is motivated to supply the voltage across the ambient temperature sensor 5 therethrough to the analog-to-digital converter 20. The analog-to-digital converter 20 then converts the analog voltage signal into a digital signal which is subsequently supplied to the microprocessor 21. Thus, the microprocessor 21 grabs data representative of the ambient temperature in the environment in which the intermediate transfer drum D is installed, so that the microprocessor 21 can calculate, making reference to an internal reference table, a target temperature to which the intermediate transfer medium 2 is to be heated in dependence on the detected ambient temperature. Thereafter, the microprocessor 21 switches the infrared lamp 3 on to initiate the heating of the intermediate transfer medium 2. On the other hand, the selector 19 is operated by the microprocessor 21 to connect the voltage across the surface temperature sensor 4 to the analog-to-digital converter 20. In a manner similar to that described above, data indicative of the temperature of the intermediate transfer medium 2 is inputted to the microprocessor 21 so that the microprocessor 21 can compare the surface temperature of the intermediate transfer medium 2 with the target temperature.

When the microprocessor 21 determines that the surface temperature of the intermediate transfer medium 2 detected by the surface temperature sensor 4 is lower or higher than the target temperature, the microprocessor 21 causes the relay 22 to switch the infrared lamp 3 on or off, respectively, so that the temperature of the intermediate transfer medium 2 can be maintained at a predetermined warming value at all times during the operation of the thermal ink recording apparatus. This predetermined warming temperature at which the intermediate transfer medium 2 is maintained is generally chosen to be of such a value that, at that predetermined warming temperature, the cohesive strength of the ink material forming the ink ribbon 7 can be greater than the adhesive strength of the ink material relative to the recording paper 15 and, at the same time, the ink material can be softened for deposit on the recording paper 15.

Although this predetermined warming temperature of the intermediate transfer medium 2 may vary depending on characteristics of the ink material forming the ink ribbon 7, the type of material for the intermediate transfer medium 2 and/or conditions under which the thermal ink recording is performed, it may be 70° C. when the ambient temperature detected by the ambient temperature sensor 5 reads 20° C. In any event, according to the present invention, the predetermined warming temperature may take a relatively high value if the ambient temperature is low, but may take a relatively low value if the ambient temperature is high. By way of example, when the ambient temperature reads 0° C. and 40° C., the predetermined warming temperature of the intermediate transfer medium 2 may be 65° C. and 75° C., respectively.

When a recording command is inputted, the thermal recording head 10 is driven to press the ink ribbon 7 against the intermediate transfer drum D and, at the same time, the intermediate transfer drum D and the ink ribbon 7 are caused to move in respective directions as indicated by the arrows in FIG. 1. When a recording signal is sequentially applied to some or all of the heating elements of the thermal recording head 10, the heating elements sequentially receiving the recording signal are heated to fuse respective portions of the ink layer 9 for deposit on the intermediate transfer medium 2 forming a part of the intermediate transfer drum D. During a continued rotation of the intermediate transfer drum D while the ink ribbon 7 is wound from the supply reel 11 onto the take-up reel 12 at a speed synchronized with the peripheral velocity of the intermediate transfer drum D, these fused portions of the ink layer 9 are detached from the backing 8 for deposit onto the intermediate transfer medium 2 while the ink ribbon 7 is separated away from the intermediate transfer drum D onto the take-up reel 12.

It is to be noted that non-fused portions of the ink layer 9 other than the above discussed fused portions thereof are or may be softened, but are not deposited onto the intermediate transfer medium 2 because the intermediate transfer medium 2 is made of silicone rubber having a high release property sufficient to minimize adhesion of the ink material thereto. Also, since at the predetermined warming temperature of the intermediate transfer medium 2 the cohesive strength of the ink material used is greater than the adhesive strength of the ink material and, at the same time, the adhesion of the ink material to the backing 8 is higher than that to the intermediate transfer medium 2, no ink material is transferred onto the intermediate transfer medium 2.

On the other hand, those portions of the ink layer 9 which have been fused by the thermal recording head 10 exhibit a sufficiently lower viscosity than that exhibited by the non-fused portions of the same ink layer 9 and the cohesive strength of the ink material is smaller than the adhesive strength of the ink layer 9 to the backing 8 and also that to the intermediate transfer medium 2. Accordingly, so far as those fused portions of the ink layer 9 are concerned, the ink material forming the ink layer 9 undergoes a cohesive failure within the ink layer 9 and is then transferred onto the intermediate transfer medium to thereby form an ink image 16 on the outer surface of the intermediate transfer medium 2 in a pattern corresponding to the recording signal applied to the thermal recording head 10.

The temperature of the ink material heated by the thermal recording head 10 lowers subsequent to the heating. In the practice of the present invention, the ink ribbon 7 must separate from the intermediate transfer drum D while the heated ink material remains at a high temperature and exhibits a reduced cohesive force. For this purpose, in accordance with the present invention, the row of the heating elements in the thermal recording head 10 is formed on a surface region of the thermal recording head 10 confronting the intermediate transfer drum D and at a trailing side portion of the surface region of the thermal recording head 10 that is spaced 160 $\mu$m from that leading side edge of the thermal recording head 10, with respect to the direction of rotation of the intermediate transfer drum D, from which the ink ribbon 7 separates away from the intermediate transfer drum D, and at the same time, arrangement has been made such that the ink ribbon 7 can separate away from the intermediate transfer drum D about 3 milliseconds subsequent to the heating if the recording speed is chosen to be 50 mm/sec.

In the manner described above, ink images 16 are successively formed on the outer surface of the intermediate transfer medium 2 during the synchronized movement of both the intermediate transfer drum D and the ink ribbon 7 and are then transported by the intermediate transfer drum D towards the transfer station in synchronism with the arrival of the ink images 16 on the intermediate transfer drum D at the transfer station, the recording paper 15 is supplied past the transfer station while elastically urged against the intermediate transfer drum D. As the recording paper 15 moves past the transfer station, the ink images 16 on the intermediate transfer medium 2 then arriving at the transfer station are transferred onto the recording paper 15.

During the transportation of the ink images 16 from the recording station towards the transfer station, the ink images 16 remain heated to a temperature substantially equal to the predetermined warming temperature of the intermediate transfer medium 2 and are softened enough to readily adhere to the recording paper 15 at the transfer station without being accompanied by the cohesive failure. This is possible because the adhesive strength exhibited by the ink images 16 relative to the recording paper 15 at such temperature is greater than both of the cohesive strength of the ink material and the adhesive strength of the ink material relative to the intermediate transfer medium 2 which are exhibited at a temperature equal to the predetermined warming temperature.

In addition, the use of the silicone rubber as material for the intermediate transfer medium 2 is effective to facilitate a positive separation of the ink images 16 from the intermediate transfer drum D onto the recording paper 15 by the reason hereinbefore discussed and also to facilitate penetration of ink material forming the ink images 16 into surface irregularities of the recording paper 15 to thereby accomplish a firm adhesion to the recording paper 15. Thus, it is clear that regardless of the surface smoothness of the recording paper with which the thermal recording apparatus of the present invention works, a satisfactory transfer of the ink material onto the recording paper can be accomplished. The thermal recording apparatus according to the present invention is effective to accomplish a satisfactory transfer of the ink image onto the recording paper even though the recording paper has a relatively insufficient surface smoothness having relatively large surface irregularities.

It is pointed out that the adhesion or bondability of the ink material forming the ink images 16 to the recording paper is affected by the pressure exerted by the press roll 13 on the intermediate transfer drum D through the recording paper 15 intervening therebetween. The greater the contact pressure, created by the press roll 13, between the recording paper 15 and the intermediate transfer medium 2, the higher the adhesion of the ink material to the recording paper. In the illustrated instance, the contact pressure between the press roll 13 and the intermediate transfer medium 2 is chosen to be 16 kg/cm$^2$, and it has been found that under this condition a satisfactory transfer of the ink material from the intermediate transfer medium 2 to a recording paper having a Beck smoothness of 3 seconds can be accomplished.

Thus, the ink deposition on the intermediate transfer medium 2 in a pattern corresponding to the image carried by the recording signal and the image transfer from the intermediate transfer medium 2 onto the recording paper 15 are continuously carried out to accomplish a recording of the image on the recording paper.

It is to be noted that in the foregoing embodiment the cohesive force of the ink material at the time of formation of the image on the intermediate transfer medium 2 has been described as being smaller than the adhesion of the ink material to the intermediate transfer medium 2 and to the ink backing 8. However, the present invention can employ an ink ribbon of a type wherein the adhesion of the ink material to the ink backing is relatively low enough to allow a ready separation of the ink material from the ink backing during the image formation on the intermediate transfer medium.

With the thermal recording apparatus having been so constructed as hereinabove described, a series of experiments have been conducted to determine the extent to which the predetermined warming temperature of the intermediate transfer medium 2 affects the transfer of the ink material. For this purpose, a transfer test was carried out varying the predetermined warming temperature of the intermediate transfer medium 2 while, in the environment of 20° C. in temperature, the ink image 16 was, after having been formed on the intermediate transfer medium 2, transferred onto the recording paper 15 while the recording paper 15 was pressed to the intermediate transfer medium 2 by means of the press roll 13 under a contact pressure of about 16 kg/cm$^2$ with a recording speed of 50 mm/sec. The intermediate transfer medium 2 employed was made of a commercially available silicone rubber manufactured and sold by Shinetsu Polymer Kabushiki Kaisha of Japan under a tradename "KE951".

As a result of the experiments, it has been found that, when the warming temperature of the intermediate transfer medium 2 attains about 55° C., the ink image 16 starts exhibiting an adhesion followed by a partial transfer thereof onto the recording paper 15. When the warming temperature of the intermediate transfer medium 2 attains 60° C., the adhesion of the ink image 16 to the recording paper 15 becomes greater than that to the outer surface of the intermediate transfer medium 2 and, therefore, the ink image 16 is completely transferred onto the recording paper 15. The ink image so transferred onto the recording paper 15 at this time is substantially fixed thereon to a practically acceptable extent. However, when the warming temperature of the intermediate transfer medium 2 attains a value exceeding 65° C. both of the transfer and the fixing of the ink image to and on the recording paper 15 have shown a satisfactory result.

It is, however, noted that, when the warming temperature of the intermediate transfer medium 2 is higher than 85° C. a substantial quantity of the ink material forming the ink image 16 tends to remain on the outer surface of the intermediate transfer medium 2 although the transfer of the ink material from the intermediate transfer medium 2 onto the recording paper 15 takes place. The reason for this phenomenon appears to be because an increase in warming temperature over 65° C. has resulted in a reduction in cohesive strength of the ink material to a value smaller than the adhesive strength exhibited by the ink material relative to the intermediate transfer medium 2. In view of the foregoing, while in the instance now under discussion the warming temperature of the intermediate transfer medium 2 has been chosen to be 70° C., the satisfactory transfer of the ink image takes place provided that the warming temperature is within the range of 60° to 80° C.

It is pointed out that the transferability of the ink image and the fixing property of the transferred ink image may vary with the characteristics of the ink material used to form the ink layer 9 and, accordingly, the warming temperature of the intermediate transfer medium 2 may not be always limited to the particular value discussed above and may suitably be chosen in consideration of the characteristics of the ink material used. However, from a practical point of view, the present invention works satisfactorily when the warming temperature is in a range of 50° to 120° C. It is again pointed out that the warming temperature range discussed above may vary with the ambient temperature. This is because, at the moment the ink image 16 on the intermediate transfer medium 2 contacts the recording paper 15 at the transfer station, the ink material forming the ink image 16 is immediately cooled. Therefore, if the temperature of the recording paper, hence, the ambient temperature, is relatively low, the proper warming temperature range shifts to a higher level, but if the ambient temperature is relatively high, the proper warming temperature range shifts to a lower level. The microprocessor 21 shown in FIG. 3 is so programmed as to vary the warming temperature of the intermediate transfer medium 2 to a value proper for the ambient temperature.

As discussed hereinbefore, the intermediate transfer medium 2 is flexible and elastic due to the use of the silicone rubber and, for this reason, the intermediate transfer medium 2 can accommodate the surface irregularities of the recording paper sufficiently during the transfer of the ink image onto the recording paper. Also, since in the practice of the present invention, the deposition of the ink image on the intermediate transfer medium 2 and the transfer of the ink image from the intermediate transfer medium 2 onto the recording paper are carried out while the intermediate transfer medium 2 has been heated to the predetermined warming temperature, no cyclic heating and cooling is required, making it possible to provide the thermal recording apparatus capable of exhibiting a high energy efficiency and that is compact in size and simplified in structure and is therefore inexpensive.

The use of the silicone rubber as material for the intermediate transfer medium 2 is effective to bring about a condition in which the cohesive force of the ink material can be rendered to be greater than the adhesion or bondability of the ink material to the intermediate transfer medium even at a temperature at which the ink material exhibits an adhesion to the recording paper. Therefore, the thermal recording apparatus of the present invention does not substantially require the use of any cleaning unit hitherto required to remove ink residues. Additionally, since the ink material is preheated by the intermediate transfer medium at the time the ink material is deposited on the intermediate transfer medium to form the ink image thereon, the quantity of used by the thermal recording head can be advantageously minimized. It is to be noted that the ink material once heated by the thermal recording head at the recording station is hardly cooled, and this is particularly advantageous in that the ink material can readily be transferred from the intermediate transfer medium while the cohesive force of the ink material remains low.

In the foregoing embodiment of the present invention, the ink material after having been transferred onto the recording paper 15 will not leave any trace on the intermediate transfer medium 2. However, where the recording paper 15 has an extremely high surface roughness, the ink material forming the ink image 16 may not sufficiently penetrate into the surface irregularities of the recording paper, leaving a small quantity of ink material on the intermediate transfer medium 2. Similarly, where the recording paper 15 used is of a size smaller than the size of the ink image 16, a substantial amount of ink material corresponding to a portion of the ink image outside the recording paper may remain deposited on the intermediate transfer medium 2. A similar phenomenon may occur even when the recording paper has at least one perforation and/or when at least one corner portion of the recording paper is bent or folded. Under these circumstances, the intermediate transfer medium 2 is required to be cleaned to remove the ink residue. Hereinafter, a cleaning operation to remove the ink residue from the intermediate transfer medium 2 will be discussed with reference to FIG. 4.

Figure 4:
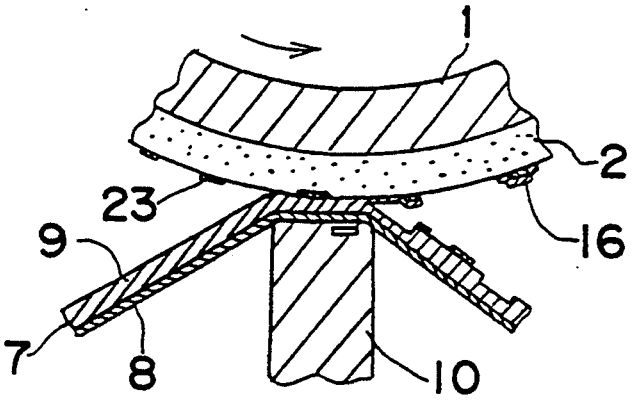
FIG. 4 is a view similar to FIG. 2, showing how ink remains are cleaned off from the intermediate transfer drum.

Where, for example, the recording paper 15 has a length greater than the circumference of the intermediate transfer drum D, the intermediate transfer drum D may be required to undergo two or more complete rotations to accomplish a complete recording of an image on the single recording paper 15. In this case, the ink residue if left on the outer peripheral surface of the intermediate transfer drum D, as indicated by 23 in FIG. 4, is brought to the recording station, where the thermal recording head 10 meets the intermediate transfer drum D, as the intermediate transfer drum D continues to rotate in the direction shown by the arrow. This phenomenon also takes place even where the intermediate transfer drum D has a circumference corresponding to the length of a single recording paper 12, but is caused to undergo two or more complete rotations to accomplish a recording an a corresponding number of recording papers.

As hereinbefore discussed, at the recording station, the thermal recording head 10 supported for movement between the rest and operative positions is, when the actual recording is to be made, driven to the operative position, pressing the ink ribbon 7 against the intermediate transfer medium 2 of the transfer drum D. At this time, the ink residue transported towards the recording position while remaining on the intermediate transfer drum D is softened due to the temperature to which the intermediate transfer medium 2 is heated, and is, accordingly, ready to adhere to the ink layer 9 of the ink ribbon 7 when the ink ribbon 7 is subsequently pressed against the intermediate transfer drum D by the movement of the thermal recording head 10 to the operative position.

Once this occurs, and since a surface of the ink ribbon 7 is very smooth on one hand and, on the other hand, the intermediate transfer medium 2 has a high ink release property as hereinbefore discussed, the ink residue 23 on the intermediate transfer medium 2 is susceptible to a ready transfer onto the ink layer 9 of the ink ribbon 7. More specifically, since the tendency of the ink residue 23 to adhere to the ink layer 9 of the ink ribbon 7 is higher than that to the intermediate transfer medium 2 due to the softening of the ink residue 23 and also to the high ink release property of the intermediate transfer medium 2, and since the cohesive strength of the ink layer 9 is greater than the adhesive strength of the ink residue 23 relative to the intermediate transfer drum 2, the ink residue 23 remaining on the intermediate transfer medium 2 is separated from a non-image area of the intermediate transfer medium 2 during the next cycle of image recording and is then deposited on the ink layer 9, thereby completing the removal of the ink residue from the intermediate transfer medium 2.

Should the ink residue 23 remain on a portion (an image area) of the intermediate transfer medium 2 which would be covered by the image to be subsequently formed on the intermediate transfer medium 2 at the recording station, that ink residue 23 is fused by the thermal recording head 10 to mix together with the ink layer 9 of the ink ribbon 7 at the recording station. At this time, since the cohesive strength of the ink material is smaller than the adhesive strength between the ink and the intermediate transfer medium 2 and also that between the ink and the ink backing 8, the ink layer 9 undergoes a cohesive failure in the layer 9 itself and is then transferred onto the intermediate transfer medium 2. Where a portion of the intermediate transfer medium 2 which would eventually form at least a part of the image area is free from the ink residue, a description similar to that described in connection with the first cycle of image forming applies.

As hereinabove described, while the ink residue which would eventually align with the image area will remain deposited on the intermediate transfer medium 2, it does not adversely affect the quality of the image finally recorded on the recording paper provided that the ink material forming the ink layer 9 is a monochrome ink. Preferably, the pressure under which the thermal recording head 10 presses the ink ribbon 7 against the intermediate transfer medium 2 is relatively high. For example arrangement has been made in the illustrated embodiment for a pressure of 3 kg or more to be applied to the ink ribbon 7 from a thermal recording head 10 having a width of 210 mm as measured in a direction parallel to the axis of rotation of the intermediate transfer drum D.

A more stable cleaning operation can be appreciated if the non-image area of the subsequently formed image is slightly heated by the thermal recording head 10 to fuse or soften the ink layer 9 to an extent that, although the adhesion between the ink layer 9 and the ink residue can be strengthened, the fused or softened ink layer 9 will not deposit on the intermediate transfer medium 2.

Thus, according to the present invention, if the intermediate transfer medium is heated to the predetermined warming temperature, the ink residue on the intermediate transfer medium can be removed onto the ink ribbon by the utilization of the pressing force exerted by the thermal recording head, with no extra member or component part being required only for the purpose of cleaning. The removal of the ink residue onto the ink ribbon and the subsequent formation of the inked image on the intermediate transfer medium 2 at the recording station take place successively.

Figure 5:
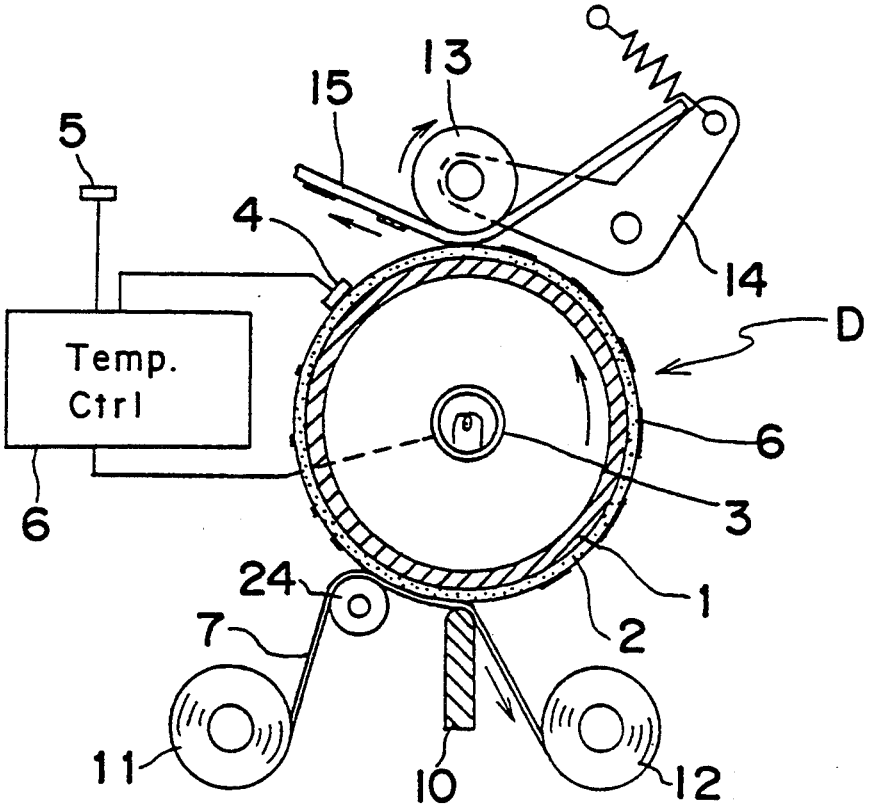
FIG. 5 is a view similar to FIG. 1, showing but the thermal recording apparatus according to a second preferred embodiment of the present invention.

Referring now to FIG. 5, there is shown a second preferred embodiment of the present invention which makes use of a cleaning member for facilitating the removal of the ink residue from the intermediate transfer medium 2.

As discussed with reference to FIG. 4, the ink residue left on the intermediate transfer medium 2 of the intermediate transfer drum D having rotated past the transfer station is subsequently brought to the recording station as the intermediate transfer drum D continues its rotation. At a location on a trailing side spaced an angular distance from the recording station with respect to the direction of rotation of the intermediate transfer drum D, a press roll 24 is disposed so as to press the ink ribbon 7 against the intermediate transfer medium 2 so that the contact time during which the ink ribbon 7 contacts the intermediate transfer medium 2 is increased. The pressure applied from the press roll 24 to the intermediate transfer medium 2 through the ink ribbon 7 is chosen to be equal to or substantially equal to that applied from the press roll 13 to the intermediate transfer medium 2 through the recording paper 15.

It will readily be seen that, since the ink residue transported towards the recording position while remaining on the intermediate transfer drum D is softened due to the temperature to which the intermediate transfer medium 2 is heated, and is, accordingly, ready to adhere to the ink layer 9 of the ink ribbon 7 when the ink ribbon 7 is subsequently pressed against the intermediate transfer drum D by the press roll 24, thereby removing the ink residue from the intermediate transfer medium 2 and onto the ink ribbon 7 being transported around the press roll 24.

According to the second embodiment of the present invention, since a substantial length of the ink ribbon 7 is caused to contact the intermediate transfer medium 2 over the angular distance from the press roll 24 to the thermal recording head 10, the ink residue on the intermediate transfer medium 2 can be assuredly cleaned therefrom and deposited onto the ink ribbon 7. This is possible because the ink residue on the intermediate transfer drum D is softened by heating while the intermediate transfer medium 2 has a high ink release property.

The second embodiment of the present invention is effective to dispense with the use of any complicated, expensive cleaning device of a type which requires the use of a cleaning member separate from the ink ribbon. This allows the thermal recording apparatus of the present invention to be made compact in size and simple in structure, to be inexpensive to manufacture and to be easy to maintain. It is to be noted that the press roll 24 may be supported for movement close towards and away from the intermediate transfer drum D in a manner similar to the support of the press roll 13. It is also to be noted that the cleaning operation may be effected either for each cycle of image recording or only when the necessity arises.

A third preferred embodiment of the present invention will now be described in which the single ink ribbon 7 once completely used over the entire length thereof is repeatedly used for recording. The thermal recording apparatus which can be used in practicing the third embodiment of the present invention is substantially identical with that shown in and described with reference to FIGS. 1 to 3. However, use is made of a reel drive means (not shown) by which the used ink ribbon 7 can be rewound at an increased speed from the take-up reel 12 back to the supply reel 11 for reuse thereof. Since in the first embodiment of the present invention the adhesive failure of ink material takes place within the ink layer 9 itself during the first cycle of image recording, the ink material remains in the ink ribbon 7, forming the ink layer 9. Therefore, the ink ribbon once used over the entire length thereof in the thermal recording apparatus according to the foregoing first embodiment of the present invention can be reused for a subsequent cycle or cycles of image recording.

Figure 6:
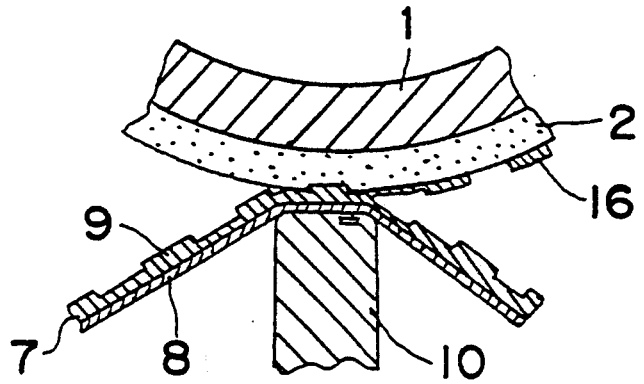
FIGS. 6 and 7 are views similar to FIG. 2, but showing third and fourth preferred embodiments of the present invention.

FIG. 6 illustrates a condition in which the used ink ribbon 7 is used to deposit ink on the intermediate transfer medium 2 during the second cycle of image recording. Although with the apparatus of FIG. 1 the used ink ribbon 7 can be reused for image recording, the reused ink ribbon 7 has surface irregularities formed on the ink layer 9, leaving partly used and non-used ink areas in the ink layer 9 in a pattern corresponding to the image which has been formed on the intermediate transfer medium 2 during the previous cycle of image recording. As a matter of course, the image recording with the use of the non-used ink areas of the ink layer 9 takes place in a manner similar to that during the first cycle of image recording. However, the thickness of respective portions of the ink layer which align with the used ink areas is reduced, but during the subsequent cycle of image recording with tire use of the used ink ribbon 7 the cohesive failure takes [,lace equally in those portions of the ink layer to accomplish a deposition of ink material on intermediate transfer medium 2.

It will readily be seen that, each time the ink ribbon 7 has been used over the entire length thereof, the thickness of the ink layer 9 is irregularly reduced. However, the use of the flexible and elastic intermediate transfer medium 2 makes it possible to level the used ink layer 7 and, therefore, a tight contact between the ink layer 9 and the surface of the intermediate transfer medium 2 is possible at the recording station to ensure a stable ink deposition on the intermediate transfer medium 2.

According to the third embodiment of the present invention the thermal recording apparatus is effective to provide an additional advantage in reducing the running cost of the ink ribbon since the latter can be repeatedly used.

Figure 7:
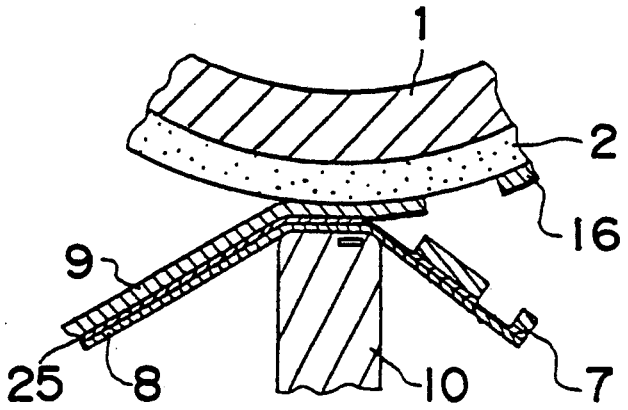

In any one of the foregoing embodiments, use has been made of the ink ribbon 7 comprising the ink backing 8 on which the ink layer 9 is formed. However, in a fourth preferred embodiment which will subsequently be described with particular reference to FIG. 7, the ink ribbon 7 has an intermediate release layer 25 formed between the ink backing 8 and the ink layer 9 so that the release layer 25 can enhance a cohesive failure of the ink layer for deposit onto the intermediate transfer medium 2 at the recording station.

The release layer 25 is made of wax of a kind having a low melt viscosity and a low cohesive strength when melted, while the ink layer 9 overlaying the release layer 25 is made of the ink material having both of the melt viscosity and the cohesive strength which are higher than those of the release layer 25. So far illustrated, by way of example, the release layer 25 is 1 μm in thickness and is made of the wax having a melt viscosity of 0.1 poise at 100° C., whereas the ink layer 9, which is 3 μm in thickness, Is made of the ink material having a melt viscosity of 1,000 poises at 100° C.

With the ink ribbon 7 of the construction described above, both the cohesive strength of the ink layer 9 and the cohesive force of the release layer 25 are higher than the adhesion strength exhibited between the ink layer 9 and the intermediate transfer medium 2, such that no ink material is transferred from the ink ribbon 7 to be deposited on the intermediate transfer medium 2 at portions corresponding to non-image areas, that is, at portions where no image is recorded. On the other hand, so far as that portion of the ink layer 8 which has been heated and hence fused is concerned, the cohesive strength of the release layer 25 becomes lower than that of the ink layer 9 and also the adhesion strength exhibited between the ink layer 9 and the intermediate transfer medium 2 and, therefore, the cohesive failure takes place in the release layer 25 to accomplish the formation of the inked image on the intermediate transfer medium 2. The manner in which the ink material forming the ink layer 9 is transferred onto the intermediate transfer medium 2 is similar to that described in connection with any one of the foregoing embodiments.

The use of the ink ribbon having the release layer intervening between the ink layer and the ink backing is advantageous in that a relatively high recording quality can be secured. Moreover, since the ink layer can be transferred in a quantity corresponding to the thickness thereof, the thickness of the ink ribbon as a whole can be advantageously reduced thereby to reduce the running cost.

Figure 8:
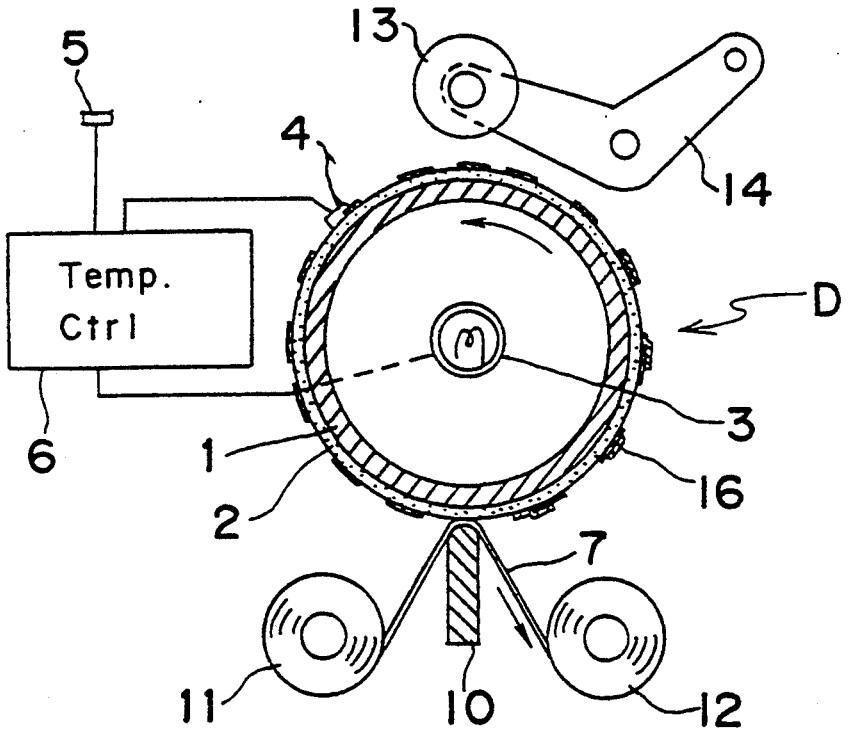
FIG. 8 is a view similar to FIG. 1, but showing a fifth preferred embodiment of the present invention.
Figure 9:
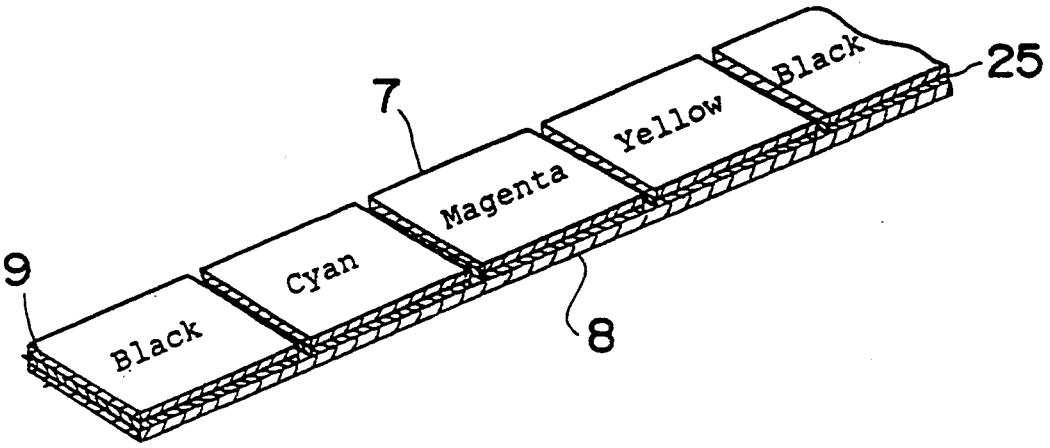
FIG. 9 .is a schematic perspective view, showing a ribbon of ink medium employed In the thermal recording apparatus of FIG. 8.

The thermal recording apparatus of the present invention can be used in color printing of images, an example of which will now be described with reference to FIGS. 8 and 9 showing a fifth embodiment of the present invention. In the case of the color image printing, the ink ribbon 7 used for this purpose is of a type comprising the ink backing 8 having the ink layer 9 formed thereon through the release layer 25, said ink layer 9 being of a periodic structure of black, cyan, magenta and yellow ink segments that repetitively develops over time length of the ink ribbon as best shown in FIG. 9. It is to be noted that each of the color ink segments forming the ink layer 9 is of a size generally equal to the size of the recording paper used. The thermal recording apparatus which works with the color ink ribbon of the type shown in FIG. 9 is substantially similar to that shown in and described with reference to FIGS. 1 and 2, except that the intermediate transfer drum 1 is designed to have its circumference somewhat greater than the length of the recording paper used. The release layer 25 employed in the color ink ribbon 7 has a thickness of 1 μm and is made of, as a principle component, wax having a melt viscosity of 0.2 poise at 100° C. whereas the color ink layer 9 has a thickness of 3 μm in thickness and is made of an ink material having a melt viscosity of 1,000 poises at 100° C. The ink material is made of a mixture of resin, wax and coloring agents. The pressure roll 13 in the apparatus when used for color image printing is so supported as to apply a pressing force of about 16 kg/cm$^2$ to the intermediate transfer medium 2 through the recording paper 15 while the thermal recording head 10 when moved to the operative position applies a pressure of about 3 kg/cm$^2$ to the intermediate transfer medium 2 through the color ink ribbon 7. The employment of the different pressures, one applied through the press roll 13 and the other through the thermal recording head 10, at the recording and transfer stations, respectively, is effective to ensure advantages in that the inked image 16 formed on the intermediate transfer medium 2 is not transferred back to the color ink ribbon 7 at the recording station and is transferred onto the recording paper 14 only at the transfer station.

The operation of the thermal recording apparatus with the use of the color ink ribbon 7 will now be described. Assuming that the black ink segment of the color ink ribbon 7 is first brought into registry with the recording station, the black ink material forming the black ink segment undergoes the cohesive failure at the release layer and is then transferred onto the intermediate transfer medium 2 to thereby form a block inked image thereon, in a manner substantially similar to that described in connection with any one of the foregoing embodiments. At the time of formation of the inked image on the intermediate transfer medium 2. The press roll 13 is held at a position separated from the intermediate transfer medium 2.

After the formation of the black ink image on the intermediate transfer medium 2, the cyan ink material forming the cyan ink segments of the color ink ribbon 7 is similarly transferred onto the intermediate transport medium 2 so as to overlap the black inked image. Since at the time of formation of the cyan inked image over the black inked image the pressure applied from the thermal recording head 10 to the intermediate transfer medium 2 through the color ink ribbon 7 is relatively low, the adhesive strength of the inked image 16 relative to the color ink ribbon 7 does not become high and lower than the adhesive strength of the inked image 16 relative to the intermediate transfer medium 2. Therefore, the black inked image formed on the intermediate transfer medium 2 will not be transferred from the intermediate transfer medium 2 back to the color ink ribbon 7.

In a manner similar to that described above, the magenta and yellow ink material forming the magenta ink segment and the yellow ink segment, respectively, are successively transferred onto the previously formed inked images oil the intermediate transfer medium 2. Even in this case, since the intermediate transfer medium 2 is made of the flexible and elastic silicone rubber, any ink material can tightly adhere to the intermediate transfer medium 2 and the subsequent overlapping of colored ink materials can be accomplished favorably.

According to the foregoing embodiment, recording of an image takes place to the intermediate transfer medium 2 of the intermediate transfer drum D prior to the transfer thereof onto the recording paper 15, and the supply of the recording signal to the thermal heating head 10 should be synchronized with the position of rotation of the intermediate transfer drum D to accomplish a precise repositioning of one color image relative to the other color image on the intermediate transfer medium 2.

After the color ink materials forming the black, cyan, magenta and yellow ink segments, respectively, have been deposited on the intermediate transfer medium 2 in overlapping relationship with each other to form an inked image in a desired color, this color inked image is subsequently and during the rotation of the intermediate transfer drum D brought to the transfer station at which the recording paper 15 urged by the press roll 13 is pressed against the color inked image to receive the latter. Since at the transfer station the pressure applied from the press roll 13 to the intermediate transfer medium 2 through the recording paper 15 is relatively high and the adhesive strength of the color inked image 16 relative to the recording paper 15 becomes higher than the cohesive strength of the ink material and the adhesive strength between the inked image 16 and the intermediate transfer medium 2. The color inked image 16 is completely transferred onto the recording paper to complete a color recording on the recording paper 15.

According to the foregoing fifth embodiment of the present invention, use is made of the ink ribbon 7 having the ink layer 9 comprising a repetition of the different color ink segments. The intermediate transfer drum 2 is driven a number of revolutions generally equal to the number of colors employed for the color ink segments to accomplish the formation of the color inked image on the intermediate medium 2 in overlapping relationship. However, use may be made of a plurality of ink sheets, one for each color, in combination with a corresponding number of the thermal recording heads disposed around intermediate transfer drum 2 in a circumferentially spaced relation with each other.

Even in the practice of the foregoing fifth embodiment of the present invention, the heating of the intermediate transfer medium 2 to the predetermined warming temperature is effective to facilitate the transfer of the color inked image onto the recording paper even though the recording paper used has a relatively low surface smoothness. Also, since the inked images in the different colors are overlapped with each other on the intermediate transfer drum D, the color alignment can be accurately accomplished.

Figure 10:
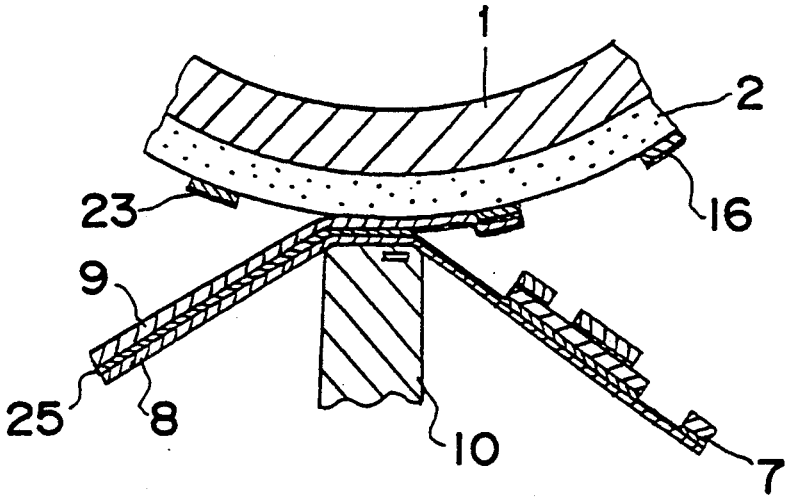
FIG. 10 is a view similar to FIG. 2, but showing a sixth preferred embodiment of the present invention.

Referring now to FIG. 10 showing a sixth preferred embodiment of the present invention, an operation of the thermal recording apparatus of the construction shown in FIGS. 8 and 9 to clean the color ink residue from the intermediate transfer medium 2 after the color inked image has been transferred onto the recording paper will be described.

The thermal recording apparatus used in the practice of the sixth embodiment of the present invention is substantially identical with that shown in FIG. 8. However, the color ink ribbon used is of a type wherein a viscous material is painted only over an outer surface of each of the black ink segments. In addition, arrangement has been made that, during the first formation of the black inked image on the intermediate transfer medium 2, the thermal recording head 10 driven to the operative position can apply a higher pressure to the intermediate transfer medium 2 through the color ink ribbon 7 than that accomplished during the subsequent formation of inked image in any color other than black. So far illustrated, the pressure applied from the thermal recording head to the intermediate transfer medium 2 during the first formation of the black inked image on the intermediate transfer medium 2 may be three times that applied during the subsequent formation of the inked image in any one of the other colors than black.

As discussed with reference to FIG. 4, the ink residue 23 left on the intermediate transfer medium 2 of the intermediate transfer drum D having rotated past the transfer station is subsequently brought to the recording station as the intermediate transfer drum D continues its rotation. At the recording station, not only does the intermediate transfer medium 2 meet the color ink ribbon 7, but also the thermal recording head 10 is brought into contact with the intermediate transfer medium 2 with the color ink ribbon 7 intervening therebetween for the subsequent formation of an inked image in a different color on the intermediate transfer medium 2. Since as described above the pressure under which the thermal recording head is brought into contact with the intermediate transfer medium 2 during the first formation of the inked image on the intermediate transfer medium 2 is greater than that during the subsequent formation of the inked image in the different color and since the black ink segment of the color ink ribbon 7 which is used during the first formation of the color inked image on the intermediate transfer medium 2 is applied the viscous material on its outer surface, the ink residue 23 will produce an adhesion strength relative to the black ink segment of the color ink ribbon 7. This adhesion strength produced by the ink residue 23 to the black ink segment of the color ink ribbon 7 is higher than that of the ink residue 23 relative to the intermediate transfer medium 2, and therefore, the ink residue 23 adhering to the color ink ribbon 7 is separated from the intermediate transfer medium 2 at a non-image area of the subsequently formed inked image and is then removed therefrom onto the black ink segment of the color ink ribbon 7. At the image area, the ink residue 23 is fused by the thermal recording head 10 to mix together with the ink layer 9 of the color ink ribbon 7. Since at this time the cohesive strength of the release layer 25 becomes lower than the cohesive strength between the ink material and the intermediate transfer medium 2 and also the cohesive strength of the ink layer 9, the release layer 25 undergoes an adhesive failure within the layer 25 itself such that it transfers together with the ink layer 9 onto the surface of the intermediate transfer medium 2. Accordingly, the ink residue 23 remains on the intermediate transfer medium 2 having been overlapped with the ink layer 9.

So far as a portion of the intermediate transfer medium 2 where no ink residue exists, but an inked image will subsequently be formed, is concerned, a phenomenon similar to that of normal recording occurs. Thus, although the ink residue 23 remains deposited on the intermediate transfer medium 2 at the image area, it remains deposited on a portion where the black ink material is to be deposited and, therefore, it can be covered up by the black ink material without detrimentally affecting the eventually formed image.

According to the foregoing description of the sixth embodiment of the present invention, the cleaning to remove the ink residue from the intermediate transfer medium 2 is carried out simultaneously with the formation of the inked image thereon with the black ink segment being used first. Accordingly, an inked image substantially free from any deterioration can be obtained. Moreover, the thermal recording apparatus does not require any complicated, expensive cleaning device of a type which requires the use of a cleaning member separate from the ink ribbon. This allows the thermal recording apparatus of the present invention to be made compact in size and simple in structure, to be inexpensive to manufacture and to be easy to maintain. At the same time, the thermal recording apparatus can be operated at a high recording speed.

Furthermore, since the black ink residue is caused to exhibit a higher adhesive strength than that exhibited by the ink of any one of the colors other than black, the operation in which the cleaning is effected only to the first formed black ink residue and will not be effected to the ink material of any other color can be stabilized. In addition, since the pressure applied from the thermal recording head to the intermediate transfer medium 2 only during the formation of the black inked image is higher than that applied during the formation of the inked image in any other color the operation in which only the first formed black ink residue, and not the ink material of any other color, is cleaned can be stabilized.

Although the present invention has been described in connection with the preferred embodiments thereof with reference to the accompanying drawings, it is to be noted that various changes and modifications are apparent to those skilled in the art. By way of example, although the intermediate transfer medium has been shown and described as formed on the metallic cylinder 1, it may be formed on a generally endless belt.

Also, in place of the thermal recording head an electrically powered recording system with a combination of a resistance sheet and a multi-stylus head or a laser heating system may be employed as the recording head.

Such changes and modifications are to be understood as included within the scope of the present invention as defined by the appended claims, unless they depart therefrom.

What is claimed is:

1. A thermal recording apparatus which comprises:
   - an intermediate transfer member having a layer of silicone rubber formed on one surface thereof;
   - an ink sheet having a thermally fusible ink layer formed on an ink backing;
   - an image forming means operable to press the ink sheet against the intermediate transfer member and also to heat the ink layer so as to selectively form an inked image on the intermediate transfer member while the ink sheet is pressed against the intermediate transfer member;

an ink sheet drive means for separating the ink sheet away from the intermediate transfer member after the inked image has been formed by the image forming means on the intermediate transfer member;

a pressing means for pressing a recording sheet against the intermediate transfer member having the inked image formed thereon;

a heating means for heating the intermediate transfer member to a predetermined temperature at which a of an ink material forming the ink layer is higher that an adhesive strength between the ink material and the intermediate transfer member and at which the inked image on the intermediate transfer medium is softened enough to be transferred onto the recording sheet for deposit thereon; and said inked image being formed on the intermediate transfer member which is heated to the predetermined temperature and being subsequently transferred onto the recording sheet while the recording sheet is pressed against the intermediate transfer member, to thereby complete a recording of the inked image on the recording sheet.

2. The apparatus as claimed in claim 1, wherein said heating means includes an ambient temperature sensor for detecting an ambient temperature where the apparatus is installed, and wherein the predetermined temperature is controlled in dependence on the ambient temperature detected by said ambient temperature sensor.

3. A thermal recording apparatus which comprises:

an intermediate transfer member having a layer of silicone rubber formed on one surface thereof;

an ink sheet having a thermally fusible ink layer formed on an ink backing;

an image forming means operable to press the ink sheet against the intermediate transfer member and also to heat the ink layer so as to selectively form an inked image on the intermediate transfer member while the ink sheet is pressed against the intermediate transfer member;

an ink sheet drive means for separating the ink sheet away from the intermediate transfer member after the inked image has been formed by the image forming means on the intermediate transfer member;

a pressing means for pressing a recording sheet against the intermediate transfer member having the inked image formed thereon;

a heating means for heating the intermediate transfer member to a predetermined temperature at which a cohesive strength of an ink material forming the ink layer is higher than an adhesive strength between the ink material and the intermediate transfer member and at which the inked image on the intermediate transfer medium is softened enough to be transferred onto the recording sheet for deposit thereon; and wherein said inked image is formed on the intermediate transfer member which is heated to the predetermined temperature and is subsequently transferred onto the recording sheet while the recording sheet is pressed against the intermediate transfer member, to thereby complete a recording of the inked image on the recording sheet; and wherein said ink sheet is separated away from the intermediate transfer member under a condition in which the ink material forming the inked image is in a melted state and a cohesive strength of the melted ink material is lower than an adhesion strength between the ink material and the intermediate transfer member, said ink material undergoing a cohesive failure as the ink sheet is separated away from the intermediate transfer member leaving the inked image thereon.

4. The apparatus as claimed in claim 3, wherein a portion of the ink sheet is used repeatedly.

5. A thermal recording apparatus which comprises:

an intermediate transfer member having a layer of silicone rubber formed on one surface thereof;

an ink sheet including an ink backing, a thermally fusible release layer formed on the ink backing and a thermally fusible ink layer formed over the release layer;

an image forming means operable to press the ink sheet against the intermediate transfer member and also to heat the ink layer so as to selectively form an inked image on the intermediate transfer member while the ink sheet is pressed against the intermediate transfer member;

an ink sheet drive means for separating the ink sheet away from the intermediate transfer member after the inked image has been formed by the image forming means on the intermediate transfer member;

a pressing means for pressing a recording sheet against the intermediate transfer member having the inked image formed thereon;

a heating means for heating the intermediate transfer member to a predetermined temperature at which a cohesive strength of any one of the release layer and an ink material forming the ink layer is higher than an adhesive strength between the ink material and the intermediate transfer member and at which the inked image on the intermediate transfer medium is softened enough to be transferred onto the recording sheet for deposit thereon; and wherein, when the ink sheet is to be separated away from the intermediate transfer member subsequent to the inked image being formed thereon, a cohesive strength of the release layer at a portion where the inked image is formed is lower than a cohesive strength of the ink material and lower than an adhesive strength between the ink material and the intermediate transfer member, and wherein said inked image is formed on the intermediate transfer member by causing the release layer to undergo a cohesive failure, said inked image being subsequently transferred onto the recording sheet while the recording sheet is pressed against the intermediate transfer member, to thereby complete a recording of the inked image on the recording sheet.

6. A thermal recording apparatus which comprises:

an intermediate transfer member having a layer of silicone rubber formed on one surface thereof;

an ink sheet having a thermally fusible ink layer formed on an ink backing;

an image forming means operable to press the ink sheet against the intermediate transfer member and also to heat the ink layer so as to selectively form an inked image on the intermediate transfer member while the ink sheet is pressed against the intermediate transfer member;

an ink sheet drive means for separating the ink sheet away from the intermediate transfer member after the inked image has been formed by the image forming means on the intermediate transfer member;

a pressing means for pressing a recording sheet against the intermediate transfer member having the inked image formed thereon;

a heating means for heating the intermediate transfer member to a predetermined temperature at which a cohesive strength of an ink material forming the ink layer is higher than an adhesive strength between the ink material and the intermediate transfer member and at which the inked image on the intermediate transfer medium is softened enough to be transferred onto the recording sheet for deposit thereon; and wherein said inked image is formed on the intermediate transfer member which is heated to the predetermined temperature and is subsequently transferred onto the recording sheet while the recording sheet is pressed against the intermediate transfer member, to thereby complete a recording of the inked image on the recording sheet; and wherein said intermediate transfer medium, said ink sheet and said image forming means together constitute a means for removing, from the intermediate transfer member, ink residue left on the intermediate transfer member subsequent to the transfer of the inked image onto the recording sheet by causing the ink sheet to contact the intermediate transfer member and the ink residue to be transferred from the intermediate transfer member onto the ink sheet.

7. The apparatus as claimed in claim 6, wherein said image forming means is operable to press the ink sheet against the intermediate transfer medium to receive the ink residue and wherein, at the time of formation of the inked image on the intermediate transfer member, an ink residue remaining on the intermediate transfer member at a location corresponding to a non-image area of the inked image is cleaned from the intermediate transfer member.

8. A thermal recording apparatus which comprises:

an intermediate transfer member having a layer of silicone rubber formed on one surface thereof;

an ink sheet having a thermally fusible ink layer formed on an ink backing, said ink layer including a cyclically extending row of thermally fusible ink segments of different colors;

an image forming means operable to press the ink sheet against the intermediate transfer member and also to heat the ink layer so as to selectively form an inked image on the intermediate transfer member while the ink sheet is pressed against the intermediate transfer member;

an ink sheet drive means for separating the ink sheet away from the intermediate transfer member after the inked image has been formed by the image forming means on the intermediate transfer member;

a pressing means for pressing a recording sheet against the intermediate transfer member having the inked image formed thereon;

a heating means for heating the intermediate transfer member to a predetermined temperature at which a cohesive strength of an ink material forming the ink layer is higher than in adhesive strength between the ink material and the intermediate transfer member and at which the inked image on the intermediate transfer medium is softened enough to be transferred onto the recording sheet for deposit thereon; and wherein a cycle of forming said inked image on the intermediate transfer member which is heated to the predetermined temperature is carried out for each color to form the inked image comprising color inked image components overlapping with each other, said color inked image being subsequently transferred onto the recording sheet while the recording sheet is pressed against the intermediate transfer member, to thereby complete a recording of the color inked image on the recording sheet.

9. The apparatus as claimed in claim 8, wherein a pressure exerted by the image forming means on the intermediate transfer member to press the ink sheet against said intermediate transfer member is chosen to be lower than a pressure exerted by the pressing means on the intermediate transfer member to press the recording sheet against the intermediate transfer member.

10. The apparatus as claimed in claim 8, wherein an initial formation of a black inked image on the intermediate transfer member is carried out by using one of the ink segments which is black in color, and wherein during said initial formation of the black inked image, an ink residue left on a portion of the intermediate transfer member corresponding to a non-image area is cleaned by removal onto the ink sheet.

11. The apparatus as claimed in claim 10, wherein the ink residue of black ink material remaining on the intermediate transfer member has an adhesive strength higher than that exhibited by any one of the color ink segments.

12. The apparatus as claimed in claim 10, wherein a pressure exerted by the image forming means on the intermediate transfer member to press the ink sheet against said intermediate transfer member when the black inked image is to be formed is chosen to be higher than that exerted when the inked image of any one of the other colors is to be formed on the intermediate transfer member.

* * * * *